US005857707A

United States Patent [19]

Devlin

[11] Patent Number: 5,857,707

[45] Date of Patent: Jan. 12, 1999

[54] JUKEBOX DISPLAY STRIP AND METHOD OF MAKING SAME

[76] Inventor: Stephen M. Devlin, 2184 Rebecca Dr., Hatfield, Pa. 19440

[21] Appl. No.: 641,861

[22] Filed: May 2, 1996

[51] Int. Cl.[6] ..... B42D 15/00

[52] U.S. Cl. ..... 283/56; 283/74; 283/79

[58] Field of Search ..... 283/72, 74, 75, 283/79, 81, 56, 55, 117; 40/299, 340, 625; 206/308.1

[56] References Cited

U.S. PATENT DOCUMENTS 3,774,839 11/1973 Woods .
4,623,062 11/1986 Chase et al. .
4,704,796 11/1987 Gauer .
4,831,758 5/1989 Williams et al. .
4,936,919 6/1990 Matsumoto et al. .
5,068,742 11/1991 Oshikoshi et al. .
5,072,253 12/1991 Patton .
5,513,749 5/1996 Simmons ..... 206/308.1
5,722,538 3/1998 Neely et al. ..... 206/308.1
5,748,608 5/1998 Spector ..... 206/308.1

*Primary Examiner*—Willmon Fridie, Jr.
*Attorney, Agent, or Firm*—Panitch Schwarze Jacobs & Nadel, P.C.

[57] ABSTRACT

A display strip for a CD jukebox which includes the artwork from a CD jacket along with a list of titles associated with the CD is constructed on a single piece of paper. A method for constructing the CD jukebox display strip includes the steps of scanning a graphic image of a CD jacket, editing the scanned image, overlaying the image onto a template, inserting song track and title information, printing the image and trimming the image to size.

11 Claims, 8 Drawing Sheets

JUKEBOX DISPLAY STRIP AND METHOD OF MAKING SAME

FIELD OF THE INVENTION

The present invention relates to information display indicia and, in particular, to a title strip for use in a CD jukebox.

BACKGROUND OF THE INVENTION

Music jukeboxes are well known. Jukeboxes are often found in diners, bars, restaurants, bowling alleys, and other similar type establishments. Up until the early 1980's two-sided 7" vinyl records (45's) were the predominant format in use on jukeboxes. The artist name and "A" side, "B" side song titles were commonly displayed on a small rectangular piece of stock paper, approximately one inch high by three inches wide, placed in a display tray on the front of the jukebox to facilitate the selection of a desired record for playing. The stock paper display product was commonly referred to as a "title strip".

Several companies produce such title strips, which are sold primarily to the coin-operated amusement industry. The companies typically supply title strips for an accepted fee to "one-stop" record suppliers. The one-stop suppliers then sell 45's along with the accompanying title strip to jukebox operators, such as Lansdale Amusement Co. of Lansdale, Pa.

In the 1980's, CD jukeboxes began to replace 45 type jukeboxes. Not only is the fidelity of a CD jukebox much better than on the older, 45 type jukebox, but also many more songs are available on a CD jukebox. For instance, assuming there are ten songs per CD and a CD jukebox has a sixty disc changer, then six hundred songs are available for selection by a user. A typical CD jukebox patron scans across the various CD titles to find a particular artist or song. The selection process then involves two steps First, the actual CD number in relation to all other CD's on the jukebox (01 through 99) is selected, and then the actual number of the desired song within a particular collection of titles (usually 01 through 12) is selected. In contrast, in a 45 jukebox, a user selected a song by selecting a number corresponding to the desired song (e.g., A13 or B13).

In order to allow a user to locate a favorite song, it is advantageous to display a CD cover or jacket, which includes artwork which is often instantly recognizable by the user. The back of the CD jacket or an inner sleeve of the CD normally contains one page or an area having a numerical listing of all song titles, in the order in which the songs are recorded on the corresponding disc. The jacket or inner sleeve can thus also be placed within the jukebox to provide the individual song and number information related to that CD.

Unfortunately, there are flaws with this method of displaying the available CD's and their corresponding song titles. The graphics from CD to CD are not consistent in content, size, or readability. Moreover, some CD's have no song title information listed anywhere. Even further, some CDs have identifying artwork printed directly on the jewel box which holds the CD or on the disc itself, and do not include or provide a traditional cover. For example, the release by the band Pink Floyd called "Pulse" is a double CD live set having very deluxe packaging, but no traditional cover or jacket. The CD's themselves are contained in an inner sleeve, which is encased in a hard bound folder on which the artwork is printed. The title strips for the Pink Floyd Pulse release provided by the one-stop suppliers comprise a plain white "cover" on which only Pink Floyd and Pulse are printed in simple text and the song title listing is provided on a separate title strip. This "cover" is a pale imitation of the exciting original.

The CD jukebox manufacturers, such as Seeburg, NSM, Rowe/AMI, Wurlitzer, Rock-Ola and Pioneer, offer various alternatives of artist/song title display methods. Some jukeboxes use the CD graphic art in conjunction with a separate artist/song title display piece (i.e., a title strip). Others use a title strip and discard the CD graphics art entirely However, unlike the 45 title strip, the CD title strip lists more than just a single song title. In addition to the artist name and the name of the recording, the CD title strip has to list all of the songs on the CD in numerical order. Accordingly, the physical size of the strip, as compared to the 45 title strip, is much larger.

Yet another problem is that a CD jukebox operator or routeman must install two separate pieces of paper for each CD (i.e., both the CD jacket and the separate song track listing or title strip) in a jukebox display tray, which takes extra time and effort.

Accordingly, it would be advantageous to provide a single means for displaying information to a user which allows the user to quickly, if not immediately identify Cds and their corresponding song tracks. It would also be advantageous to provide a title strip which is uniform in size and may be easily installed in a CD jukebox display tray.

SUMMARY OF THE INVENTION

Briefly, the present invention comprises a display strip for a jukebox for identifying a particular musical storage medium. The display strip consists essentially of a display medium having a display surface. The display medium includes a first substantially rectangular, perforated punch-out proximate a top portion thereof for allowing a jukebox disc number to be viewed therethrough. Text data is displayed on the display surface for identifying music stored on the particular musical storage medium. The text data includes at least the name of the artist(s), release title and a song title listing. An image associated with the text data is also displayed on the display surface for identifying the particular musical storage medium. The text data is overlaid on the image and the image is substantially similar to artwork associated with the particular musical storage medium or the artist(s) thereby allowing a user to quickly recognize the artist and/or release title corresponding to the particular musical storage medium.

The present invention further comprises a method of making a display strip for a CD jukebox. The method includes the steps of scanning an image off of a CD jacket or other graphic associated with a CD into a digital data file;

manipulating the image stored in the digital data file to adjust the size of the scanned image;

adding digital text data to the digital data file, the text data relating to the scanned image;

printing the digital data file, including the image and the text data onto a display medium; and trimming the display medium to a predetermined size, thereby forming the display strip.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangement and instrumentalities shown. In the drawings, which are diagrammatic.

DETAILED DESCRIPTION OF PREFERRED EMBODIMENTS

Figure 1:
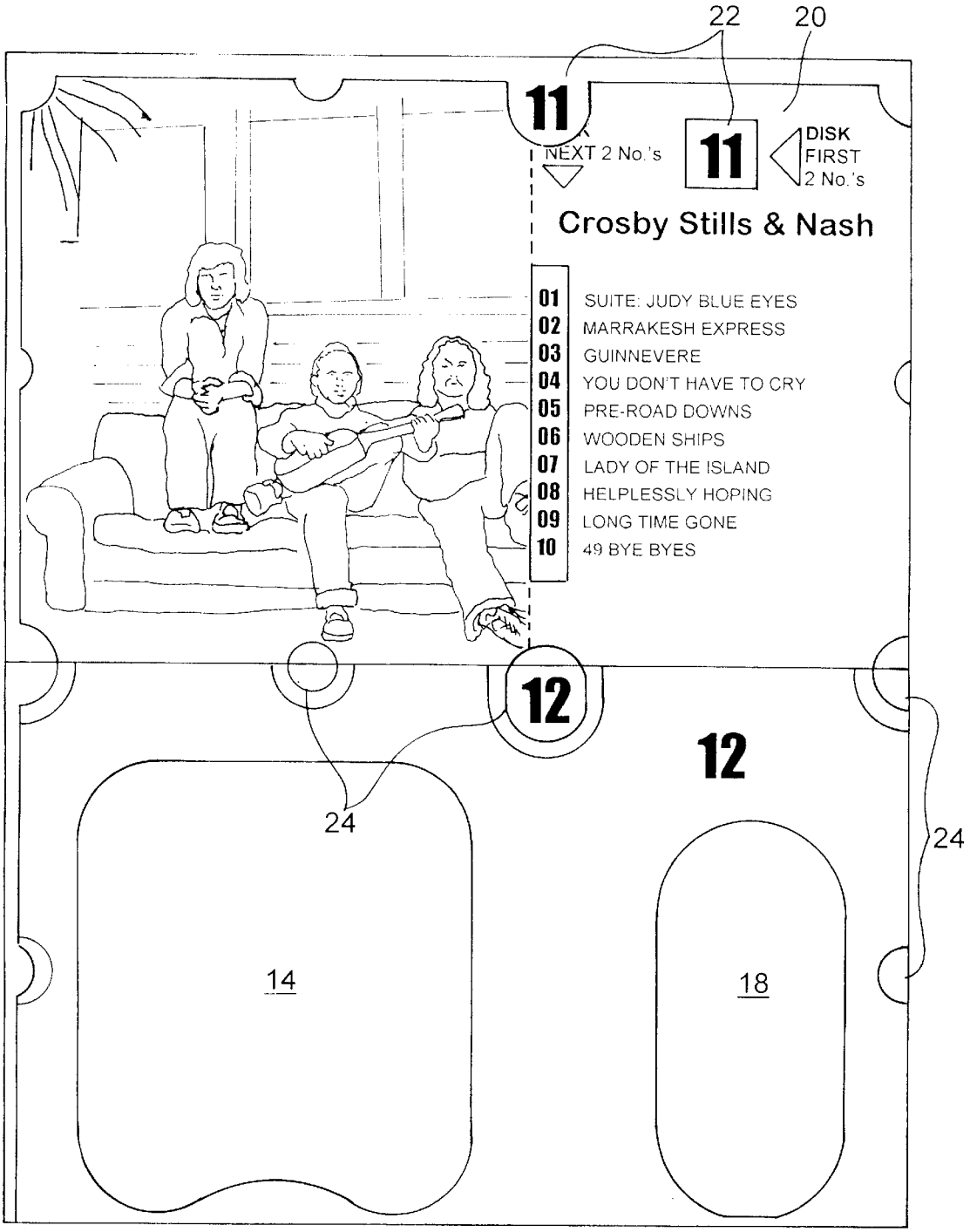
Fig. 1 (PRIOR ART)
FIG. 1 is a top plan view of a CD jukebox display tray including a CD racket and prior art title strip installed in a display area thereof.

Certain terminology is used in the following description for convenience only and is not limiting. The words "right," "left," "lower," "upper," "front" and "rear" designate directions in the drawings to which reference is made. The terminology includes the words above specifically mentioned, derivatives thereof and words of similar import.

Referring now to the drawings in detail, wherein like numerals are used to indicate like elements throughout, there are shown various embodiments of a means for displaying release title, artist and song track information on a CD jukebox. The present invention provides a single sheet of paper including a jacket image and a list of song titles for placement over both sections of the display area of a jukebox display tray, and includes punchouts for identifying an associated jukebox disc number. The present invention further provides a method of constructing a title strip for a jukebox.

FIG. 1 shows a typical CD jukebox display tray 10 having two display areas 12. The display tray 10 provides a means for indicating to a user the available Cds and the song titles on each CD, as well as an associated jukebox disc number. Each of the display areas 12 comprises two sections. A first, larger section 14 is sized to receive a CD cover or jacket 16 (shown in the upper display area) to identify an available CD. A second, smaller section 18, located adjacent to the first section 14, is sized to receive a title strip 20 (shown in the upper display area). As previously discussed, the title strip 20 is a separate piece of paper (i.e., separate from the CD jacket 16) which has a list of the CD song tracks printed thereon. Each display area 12 further includes a disc number or identifier 22. Thus, in order to play the song track "Wooden Ships", a user would select disc 11, track 06. Tabs, projections or similar means 24 are also provided for securing the CD jacket 16 and the title strip 20 within the display sections 14, 18, respectively.

Figure 2:
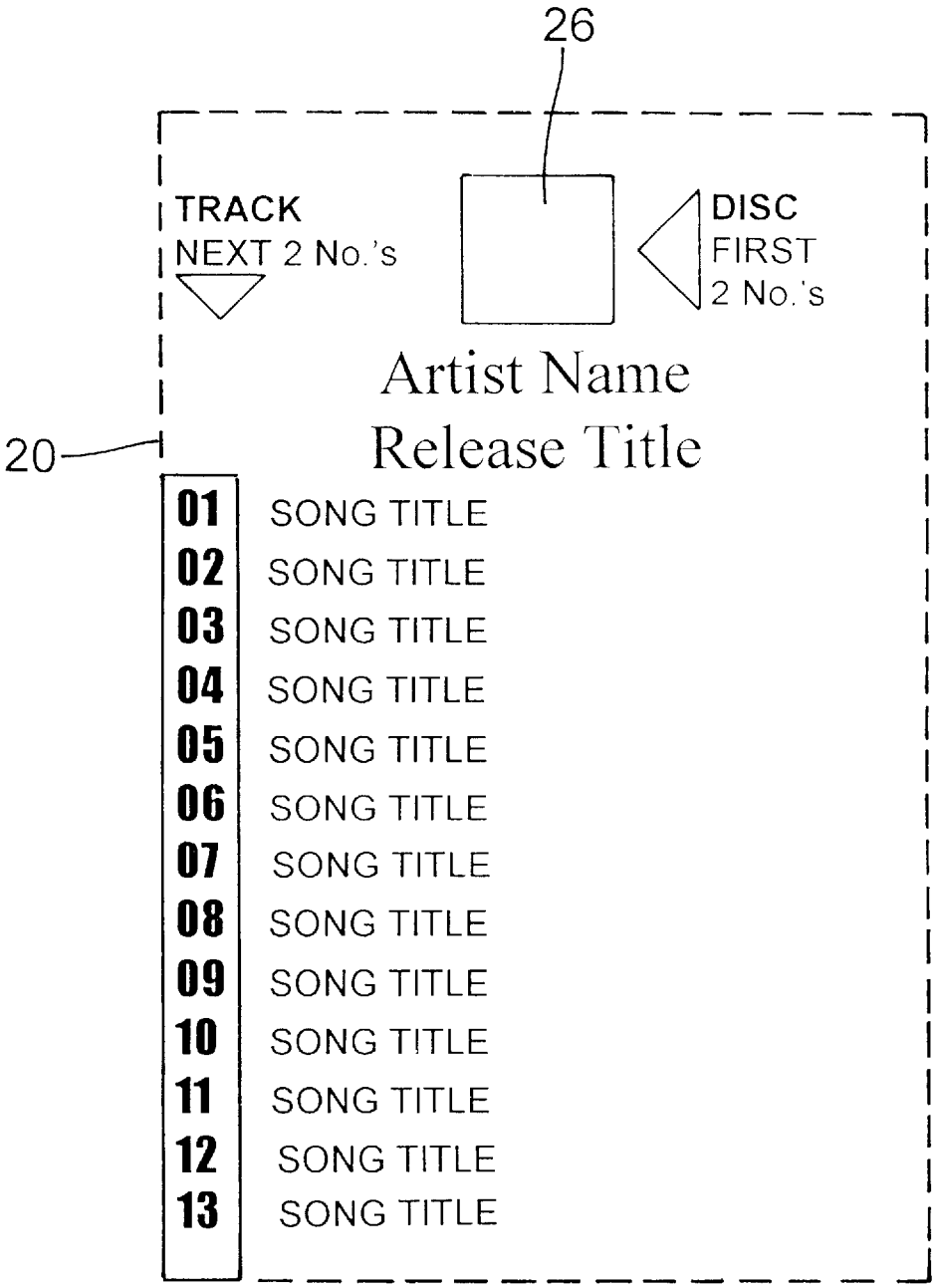
Fig. 2 (PRIOR ART)
FIG. 2 is a top plan view of a prior art title strip.

Referring now to FIG. 2, a standard, commercially available prior art title strip 20 is shown. The title strip 20 generally comprises a single, plain sheet of paper including a punchout 26 which allows the corresponding jukebox disc number or identifier 22 associated with the CD to be displayed therethrough. The title strip 20 is generally a standard size of four-and-three-quarter inches high by three inches wide so that the title strip fits within the smaller section 18 of the display area 12 of the jukebox tray 10.

In the early 1990's, Rowe, a CD jukebox manufacturer, pressed for an industry standard insert for displaying song titles in a CD jukebox. Since by this time, the record companies had settled on the jewel box as the industry standard CD package, Rowe designed a CD title Strip (see FIG. 2), that was the same height as the standard CD cover and a width of approximately two and seven-eighths inches. A hole was centered approximately one-quarter inch from the top of the strip to allow a CD identification number for the disc within the jukebox (00 through 99) to be displayed therethrough. The Rowe title strip and the corresponding CD cover are placed adjacent to each other in a CD display mechanism (FIG. 1) that conforms to the approximate dimensions for each title. The Rowe title strip version was adopted by the jukebox industry and the title strip is now referred to as the Rowe Standard. All subsequent jukeboxes have conformed to this standard. While the title strip suppliers now offer the Rowe standard title strip 20 for all CD releases, they continue to supply other title strips of varying sizes which conform to existing jukeboxes by the other CD jukebox manufacturers. Since the early 1990's, no other significant changes have occurred regarding title strip design or usage.

The typical, standard title strip 20 is constructed of stock paper with plain black type printed thereon, identifying the artist's name, release title, and a conventional listing of the song titles along the left side of the title strip 20. Instruction information is also provided proximate the top of the title strip 20 on either side of the punchout 26 indicating to a user the disc number and the track number to be entered in order to select and play a desired song title.

As previously discussed, both the title strip 20 and the corresponding CD jacket 16 must be inserted into the display tray 10 by the jukebox operator or routeman. Then, a user can view the CD jackets 16 in order to quickly identify or find desired artists and titles.

Figure 3:
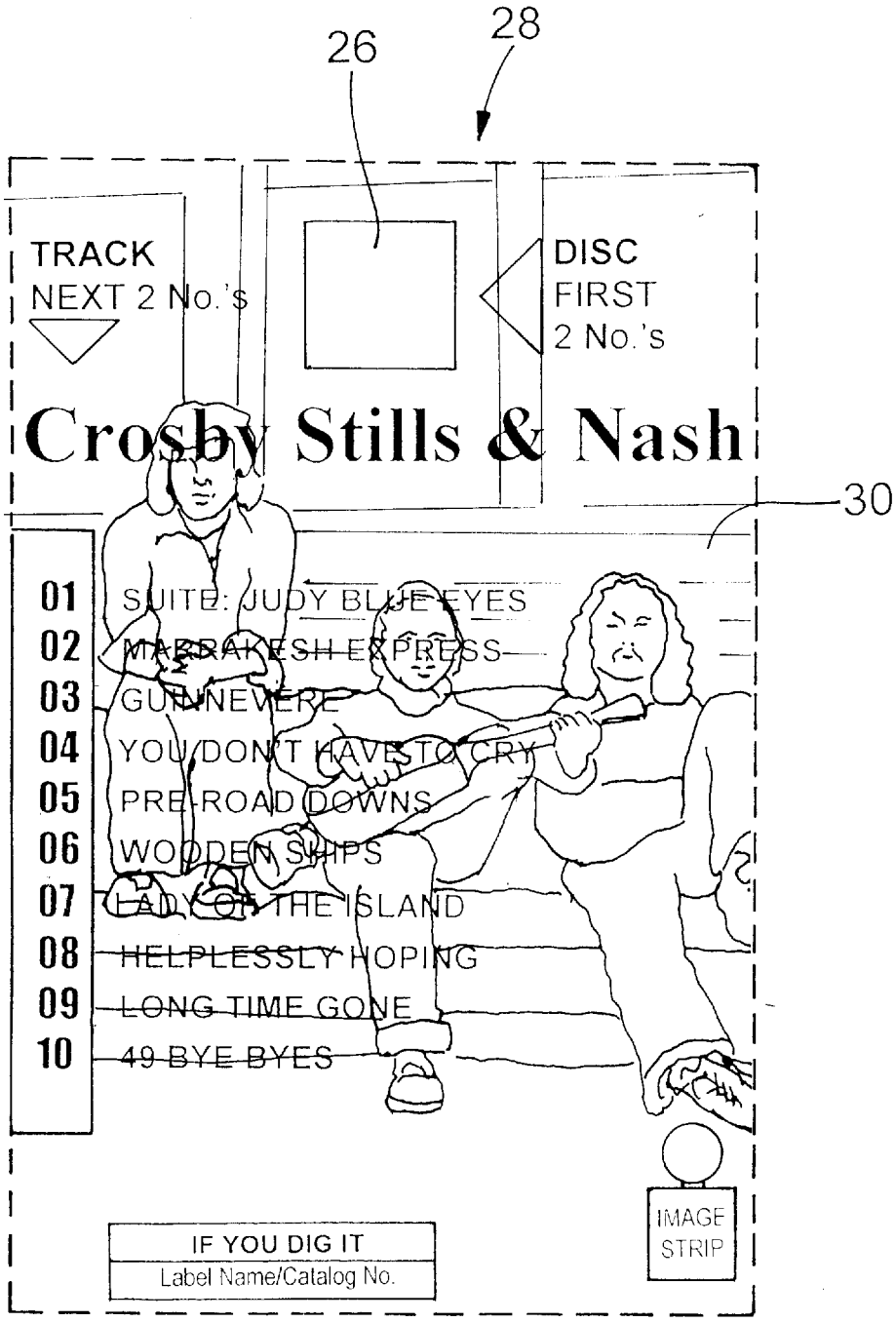
FIG. 3 is a top plan view of a first embodiment of a title strip in accordance with the present invention.

Referring now to FIG. 3, a first embodiment of a display or image strip 28 according to the present invention is shown. The display strip 28 comprises a single piece of paper sized to fit within the second, smaller section 18 of the display area 12 of the jukebox, and is meant to replace the standard, prior art title strip 20. The display strip 28 is similar to the title strip 20 shown in FIGS. 1 and 2 except that an image 30 is overlaid onto the title strip. Preferably, the image 30 corresponds to or is derived from the artwork on the CD jacket, and thus provides a means for allowing a user to quickly identify the subject matter of the display strip 28 without also having to view the CD jacket 16.

Like the title strip 20, the display strip 28 is sized to fit within the smaller section 18 of the display area 12 of the jukebox display tray 10, and also like the title strip 20, includes the punchout 26 and textual information indicating artist's name, release title and a song title listing. The punchout 26 is centered approximately one-quarter inch from the top of the display strip 28. The punchout 26 allows the CD identification number for the disc (generally 00–99) to be displayed therethrough. However, since the display strip 28 includes the image 30, and not a plain white background, as on the title strip 20, the textual information is not necessarily or always printed with black typeface. Indeed, as can be seen in FIG. 3, the song titles are printed using a double image reverse type font, according to a method of the present invention, as described in more detail below in conjunction with FIG. 9.

In the prior art, the title strip 20 is printed by an offset printing method, as is well known in the printing industry. The display strip 28 of the present invention is generated using a computer, such as an IBM compatible PC 32 (FIG. 9) including a scanner, a color printer, and graphics editing or desktop publishing software, such as Aldus Pagemaker, available from Adobe Systems, Inc. of Mountain View, Calif. Such computer systems 32 and graphics editing software are now well known and widely available. Accordingly, it is not necessary to further describe the computer system 32 used to practice the method of the present invention for a complete understanding of the present invention.

As can be seen, the display strip 28 is vastly superior to the plain title strip 20 and adds a whole new dimension to the title strip 20. A user need only scan the display strip 28, as opposed to scanning CD jackets 16 and then reading a corresponding title strip 20. The image 30 provided on the display strip 28 functions to allow a user to quickly identify music and artist(s) which are available on the jukebox.

Figure 4:
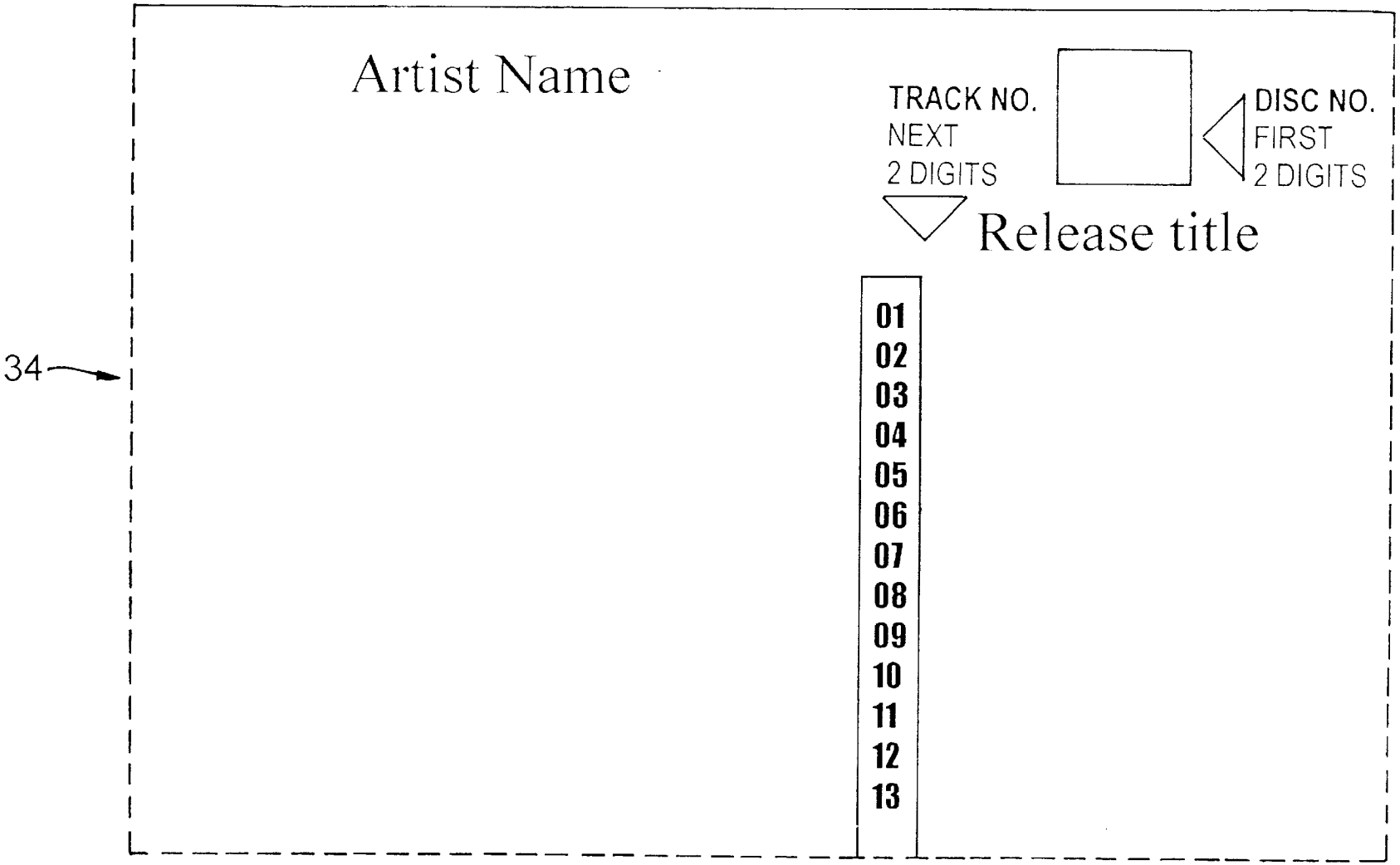
FIG. 4 is a top plan view of a template for a second embodiment of a title strip in accordance with the present invention.
Figure 5:
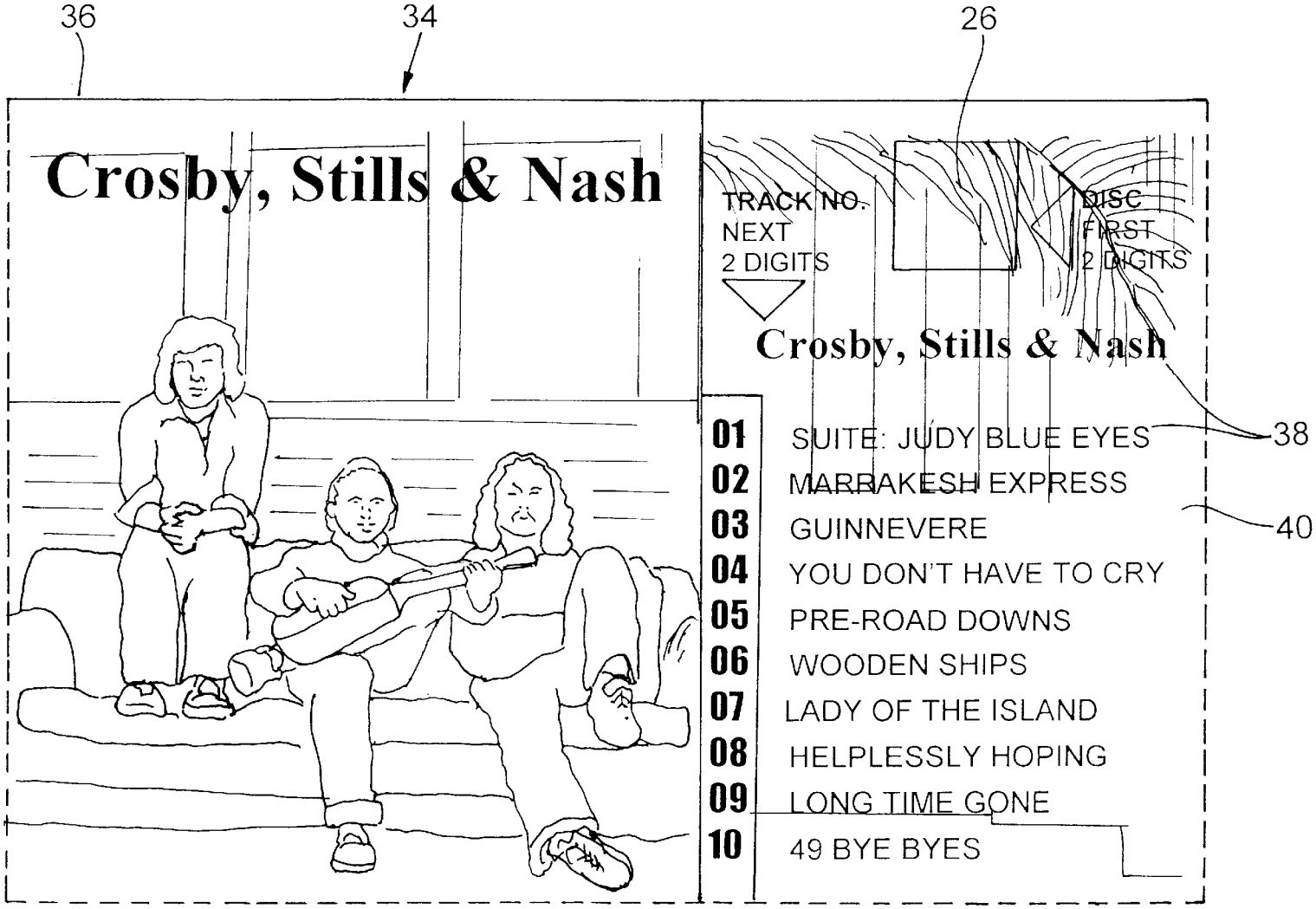
FIG. 5 is a top plan view of a second embodiment of a title strip of the present invention in accordance with FIG. 4.

Referring now to FIGS. 4 and 5, a second embodiment of a display strip 34 according to the present invention is shown. The display strip 34 comprises a single sheet of paper (as opposed to the two pieces of paper required in the prior art) having an image derived from the cover of the CD and text indicating the song tracks overlaid on the image. The display strip 34 is sized to cover both the first and second sections 14, 18 of the display area 12. The display strip 34 combines both the title strip 20 and the CD jacket 16 onto a single display medium, such as a piece of stock paper.

The layout of the display strip 34 corresponds to the combination of the CD jacket 16 and the title strip 20 when placed adjacent to each other in the jukebox display tray 10. That is, the left side of the display strip 34 comprises an image 36 which corresponds to the CD jacket 16 and the right side of the display strip 34 comprises a punchout 26 and textual information 38, including the name of the artist(s), release title and a sequential listing of the song titles, such as printed on the title strip 20. The right-hand side of the display strip 34 further comprises an image 40, preferably which also corresponds to the artwork of the particular CD available, to aid a user in quickly recognizing and finding a desired musical selection. In the presently preferred embodiment of the display strip 34, the image 36 is similar or identical the artwork on the front jacket of a CD and the image 40 corresponds to other artwork identified with the CD, such as from the back of the CD jacket. The value of applying the images 36, 40 to the display strip 34 is apparent by contrasting FIG. 4 with FIG. 5. FIG. 4 shows the display strip 34 without the images 36, 40 overlaid thereon. As such, FIG. 4 illustrates a template which can be used to generate the display strip 34.

In the presently preferred embodiment, the display strip 34 measures four-and-three-quarters inches high by seven-and-one-eighth inches wide, which corresponds to the size of the display area 12 of the jukebox display tray 10, and locates the punchout 26 near the top of the right side of the display strip 34. By using only a single piece of paper to display both the CD jacket artwork, artist name, release title and the song titles, the jukebox operator or routeman can more easily and quickly service the jukebox, since only one piece of paper need be installed into the display area 12 and since title strips 20 need not be matched with corresponding CD jackets. In addition, the original CD jacket is preserved, as opposed to being placed in the jukebox.

Figure 6:
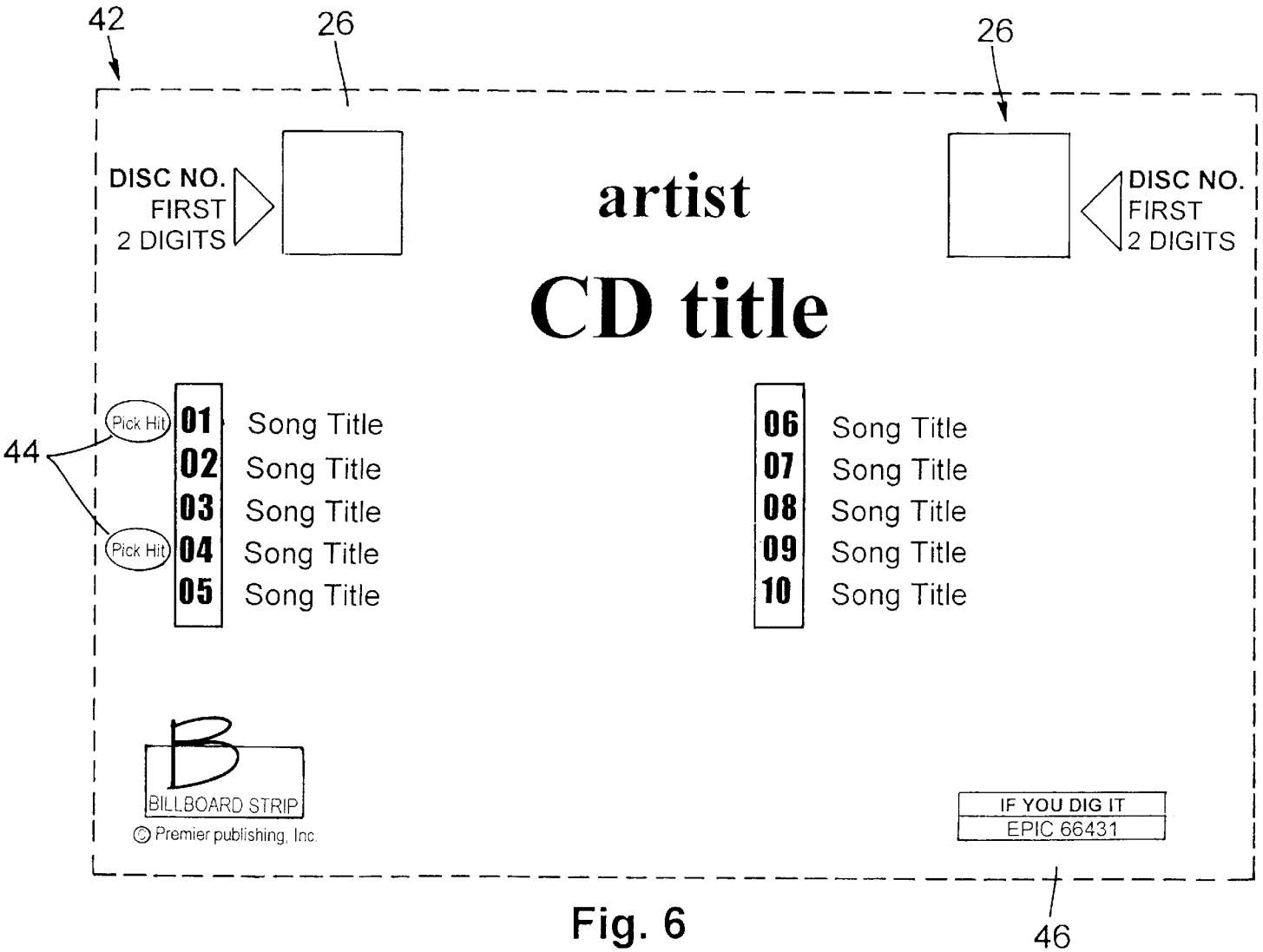
FIG. 6 is a top plan view of a template for a third embodiment of a title strip in accordance with the present invention.
Figure 7:
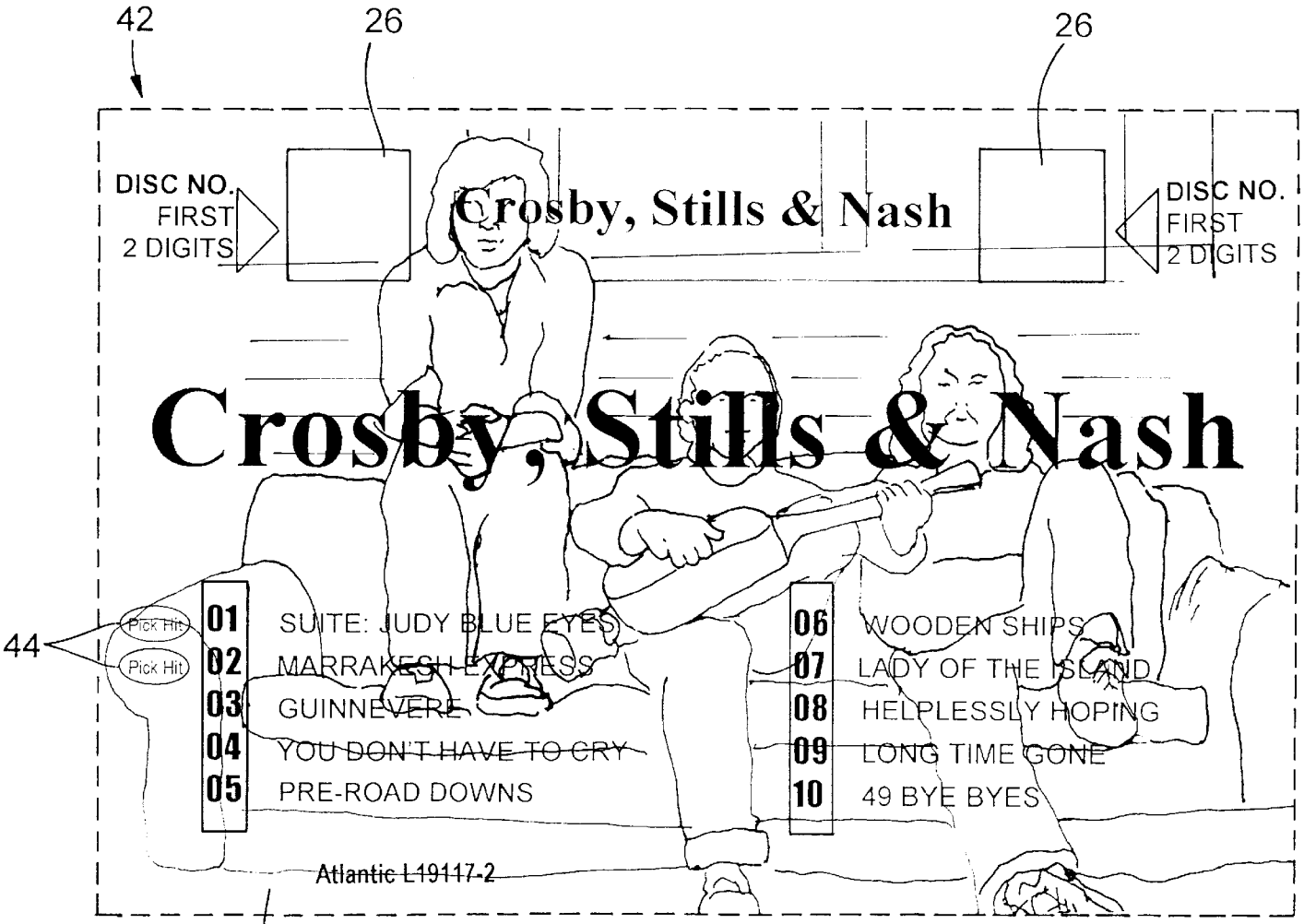
FIG. 7 is a top plan view of a third embodiment of a title strip of the present invention in accordance with FIG. 6.

Referring now to FIG. 6, a third embodiment of a display strip 42 according to the present invention is shown. The display strip 42 has the same general dimensions as the display strip 34, but includes two punchouts 26, one on an upper left side and one on an upper right side thereof. Providing two punchouts allows the display strip 42 to be used in a display tray having either a left or right graphic orientation. The display strip 42 further differs from the display strip 34 in that the textual information is centered over the entire display strip 42. That is, the display strip 42 is not broken down into a CD cover image side and a title strip 20 side. Further, as shown in FIG. 7, the image from the CD jacket is overlaid over the entire display strip 42, and the textual information is also displayed over the entire display strip 42. By using the entire display area, larger font sizes than those presently used for printing song titles on the prior art title strips 20 can be used, making the information easier to read.

The display strip 42 further includes visual indicia 44 provided proximate one or more individual song titles for indicating "hit" songs so that a user can quickly identify such popular songs. Record label and catalogue information 46 can also be included for providing the user with music publisher information. Accordingly, as can be seen, the display strips 28, 34, 42 of the present invention provide a significant improvement over the plain title strips 20 of the prior art, and as discussed, also provide a number of benefits over the prior art.

Figure 8:
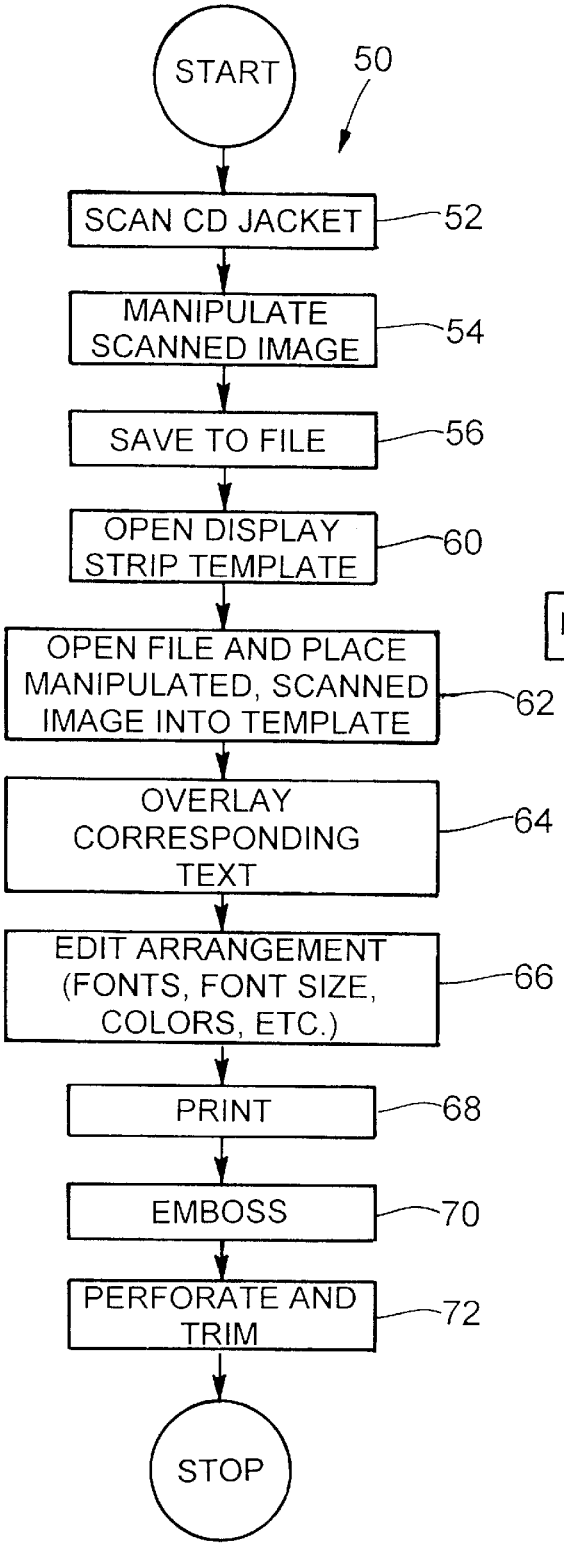
FIG. 8 is a flow chart of a method of constructing a title strip in accordance with the present invention.
Figure 9:
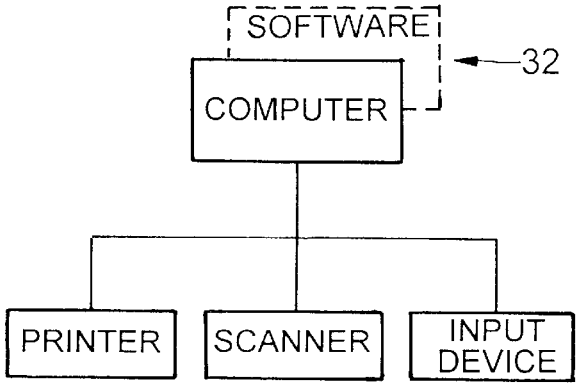
FIG. 9 is a system for practicing the novel method in accordance with FIG. 8.

Referring now to FIG. 8, a flow chart 50 of a novel method for producing the display strips 28, 34, 42 of the present invention is shown, and which may be practiced using the computer system 32 shown in FIG. 9, previously described. The initial step 52 comprises scanning the selected CD jacket or artwork 16 into a digital data file using the scanner. In the presently preferred embodiment, the scanner is a Hewlett Packard scanner, and includes software to operate the scanner. The scanner software allows the scanned image (now represented by digital data) to be edited. Accordingly, the scanned image may be cropped, stretched or otherwise manipulated (step 54) to conform with the predetermined size of the display strip 28, 34; 42. Moreover, since the generally square dimensions of a CD cover (sized and shaped to correspond to the standard jewel box package) do not precisely correspond to the dimensions of the display strips 28, 34, 42, it is presently preferred to crop the top and bottom portions of the scanned image to make scanned image smaller, and then enlarging the cropped scanned image to the display strip dimensions. In this manner, the attraction of the image is enhanced. Using the graphics editing software, the size, color, highlight/shadow, brightness/contrast, and emphasis of the scanned image can also be manipulated.

Once the scanned image is appropriately sized, the edited image can be saved to a data file, as shown in step 56. In step 58, a template for the selected display strip 28, 34, 42 is opened on the computer (see, e.g., FIGS. 2, 4, 6). Graphics editing or publishing software is used to place the edited, scanned image into the template (step 62) and to then further manipulate or edit the image and text of the display strip 28, 34, 42. That is, in step 62, the scanned image is imported into the display strip template. Although step 56 shows the edited image being stored in a data file prior to being imported into the display strip template in step 62, it will be apparent to those of ordinary skill in the art that the scanned image could be imported directly into the template without first storing the image into a data file.

Once the image is placed within the display strip template, the text corresponding to the CD artwork is overlaid on the image. That is, the text is entered and placed into desired, predetermined locations, which locations are predefined in the template. The text may be entered using a keyboard. However, the text can also be imported from a data file into which the text has previously been stored For instance, commercial databases are known which provide information, such as label, catalog number, artist name, release title, song titles, etc. One such commercial database is available from Trade Service Publications, Inc. of San Diego, Calif., which provides the aforelisted information in ASCII text format. Although the present invention includes the step of scanning the artwork off of the CD jacket, it will be understood by those of ordinary skill in the art that the image could be obtained in digital form from a music publisher, in a similar manner as the text data is provided by Trade Service Publications.

After the text has been overlaid onto the image in the display strip template, in step 66 the arrangement is further edited to provide a desired overall appearance for the display strip 28, 34, 42. For instance, the individual elements (i.e., artist name, release title, catalog information, song titles, etc.) can be changed subject to or depending upon compositional needs. The font sizes of each of the elements can be adjusted to ensure that each of the elements are easily read by a user, and indicia 44 for identifying popular song titles or identifying a particular release title or artist can be added. Other editing functions can also be performed in order to ensure readability, such as altering fonts, boldness, reverse lettering, shading or even changing background colors. For example, in FIG. 3 the song titles are printed using a reverse lettering scheme, formed by adding song title text with a black font, copying the text, reversing the color of the text to white and then printing a double image of the text (i.e., white with black outlines), such that the text is readable on either a light or dark background FIG. 3 shows the aforementioned double image text, FIG. 5 shows black text and FIG. 7 illustrates a reverse font (i.e., white).

Upon completion of editing the display strip 28, 34, 42 is printed onto a sheet of paper (step 68). In the presently preferred embodiment, stock white paper is used. However, it will be apparent to those of ordinary skill in the art that the display strip 28, 34, 42 could be printed on other suitable display media, such as cardboard of construction grade paper. In order to make the display strip 28, 34, 42 durable, in step 70 the printed display strip 28, 34, 42 is embossed. The embossing step 70 can also help to reduce the amount of reflection on the display strip 28, 34, 42. In step 72, the display strip is perforated and the punchout(s) 26 is formed therein. The punchout 26 is generally five-eighths of an inch square, although the size will vary depending upon the size of the disc identifier used on the jukebox. Also, in step 72, the display strip 28, 34, 42 is also trimmed to the desired size.

The present invention provides a number of advantages over the title strips 20 of the prior art, including preserving the original CD jacket, providing a strip which is easier to identify and install by a jukebox routeman, easier for a user to quickly identify favorite artists and popular song titles, and larger fonts or lettering can be used to improve readability. Moreover, jukeboxes can lose business if the display does not allow users to quickly recognize songs and/or artists, and the associated jukebox code which will play the song. Accordingly, the present invention comprises an inexpensive and attractive means to provide such information Additionally; although different jukebox manufacturers have different title display sizes, all conform to the four and three-quarters inch height requirement. Thus, the strips only differ in the width of the display area. The display strip 28, 34, 42 of the present invention can be shortened or extended to fit to any such requirements. In that sense, the display strip 28, 34, 42 is a truly universal display medium that can accommodate all current CD cover based jukeboxes as well as any future CD cover based jukeboxes. Moreover, since all of the information used to create the display strip 28, 34, 42 is stored digitally on the computer system 32, the textual information can be positioned at any desired location on the display strip 28, 24, 42, as opposed to locating all of the textual information on the right side of the display area 18 only.

Although the present invention is described in accordance with CD jackets and CD jukeboxes, it will be apparent to those of ordinary skill in the art that the present invention could be practiced in conjunction with other storage media, such as cassette tapes. While the preferred embodiment of the invention has been described and modifications thereto suggested, one of ordinary skill will appreciate yet other modifications, arrangements and structures would be possible to achieve the ultimate purpose of providing a display strip for a jukebox which allows a user or prospective user to quickly identify or find a songtrack. The foregoing examples are meant to be exemplary and not limiting. It is to be understood, therefore, that the invention is not limited to the particular embodiments disclosed or suggested, but is intended to cover any modifications which are within the scope and spirit of the invention, as defined by the appended claims.

I claim:

1. A display strip for a jukebox for identifying a particular musical storage medium, the display strip consisting essentially of:

a display medium having a display surface, the display medium including a first substantially rectangular, perforated punch-out proximate a top portion thereof for allowing a jukebox disc number to be viewed therethrough;

text data displayed on the display surface of the display medium for identifying music stored on the particular musical storage medium, the text data including at least the name of the artist(s); release title and a song title listing; and an image displayed on the display surface of the display medium, the image being associated with the text data for identifying the particular musical storage medium, wherein the text data is overlaid on the image and the image is substantially similar to artwork associated with the particular musical storage medium or the artist(s) thereby allowing a user to quickly recognize the artist and/or release title corresponding to the particular musical storage medium.

2. The display strip of claim 1 wherein the image is a color image.

3. The display strip of claim 1 wherein the display medium is approximately 4 and ¾ inches high by 3 inches wide.

4. The display strip of claim 1 wherein the display medium is approximately 4 and ¾ inches high by 7 and ⅛ inches wide.

5. The display strip of claim 1 further comprising an embossed finish on the display surface.

6. The display strip of claim 1 further comprising means for identifying a hit song among the song title listing.

7. The display strip of claim 1 wherein the perforated punch-out is approximately ⅝ inch square.

8. The display strip of claim 1 wherein the display medium includes a second substantially rectangular, perforated punch-out proximate the top for allowing a jukebox track number to be viewed therethrough.

9. The display strip of claim 1 wherein the display medium comprises a strip of paper.

10. The display strip of claim 1 wherein the song title text data comprises a double image reverse font.

11. A display strip for a jukebox for identifying a musical storage medium and music stored thereon, wherein the jukebox includes a plurality of display trays, each display tray including first and second display areas, each display area for receiving a display strip, the display strip consisting essentially of:

a display medium having a display surface, the display medium including a first substantially rectangular, perforated punch-out proximate a top portion thereof for allowing a jukebox disc number located on a display tray to be viewed therethrough;

an image displayed on the display surface of the display medium for identifying the music stored on the musical storage medium, wherein the image is similar to artwork associated with the particular musical storage medium or the artist(s); and text data overlaid on the image and displayed on the display surface of the display medium for identifying the music stored on the musical storage medium, the text data including at least the name of the artist(s), a release title and a song title listing, wherein the image allows a user to quickly recognize the artist and/or release title corresponding to the particular musical storage medium and the display medium is sized to fit within and cover an entire display area.

* * * * *